US005665302A

United States Patent [19]

Benni et al.

[11] Patent Number: 5,665,302

[45] Date of Patent: Sep. 9, 1997

[54] METHOD AND EQUIPMENT FOR BRINGING METAL ALLOY INGOTS, BILLETS AND THE LIKE TO THE SEMISOLID OR SEMILIQUID STATE IN READINESS FOR THIXOTROPIC FORMING

[75] Inventors: Gianni Benni, Calderara Di Reno-Bologna; Giorgio Muneratti, Polesella-Rovigo; William Taddia, Vigarano Mainarda-Ferrara; Romano Bettarelli, S. Maria Maddalena-Rovigo, all of Italy

[73] Assignee: Reynolds Wheels International Ltd., Lugano, Switzerland

[21] Appl. No.: 531,248

[22] Filed: Sep. 20, 1995

[30] Foreign Application Priority Data

Sep. 23, 1994 [IT] Italy ..... BO94A0417

[51] Int. Cl.[6] ..... F27B 9/10; F27D 3/12; F27D 7/00

[52] U.S. Cl. ..... 266/80; 266/87; 164/900; 219/385; 219/400; 392/310; 432/152; 373/109

[58] Field of Search ..... 164/900; 219/385, 219/388, 390, 400; 266/80, 87, 200, 251, 252, 255, 256, 257, 261; 392/310; 432/152; 110/315, 316; 373/119, 109

[56] References Cited

U.S. PATENT DOCUMENTS

| | | | |
|---|---|---|---|
| 1,919,650 | 7/1933 | Hagan . | |
| 2,250,868 | 7/1941 | Huff | 266/255 |
| 2,432,239 | 12/1947 | Hoak | 266/255 |
| 4,569,218 | 2/1986 | Baker et al. . | |
| 5,253,596 | 10/1993 | Coraggioso | 110/316 |

FOREIGN PATENT DOCUMENTS

| | | | |
|---|---|---|---|
| 0 513 523 A1 | 11/1992 | European Pat. Off. . | |
| 0 518 815 A1 | 12/1992 | European Pat. Off. . | |
| 0 645 206 A1 | 3/1995 | European Pat. Off. . | |
| 1 413 661 | 8/1937 | Germany . | |
| 1 194 155 | 6/1965 | Germany . | |
| 1 817 032 | 7/1970 | Germany . | |
| 2 112 676 | 7/1983 | United Kingdom . | |
| 2197883 | 6/1988 | United Kingdom | 266/252 |

OTHER PUBLICATIONS

H. Troger, *Modern Heat–Treating Furnaces with air circulation for copper–base and light alloy sections (firing method and air flow problems)*, Gas Warme International, vol. 20, No. 10, Oct. 1971, pp. 350–354.

*Primary Examiner*—Kuang Y. Lin
*Attorney, Agent, or Firm*—Darby & Darby

[57] ABSTRACT

Equipment for bringing ingots of thixotropic metal alloy to the semisolid or semiliquid state including a heat chamber for holding the solid ingots introduced at ambient temperature, and a source generating air currents within the chamber to heat the ingots principally by convection, and a unit for controlling the temperature of the ingots. The ingots are supported and conveyed through a circular path internally of the heat chamber by a set of radial platforms revolving between an infeed zone and an outfeed zone.

11 Claims, 3 Drawing Sheets

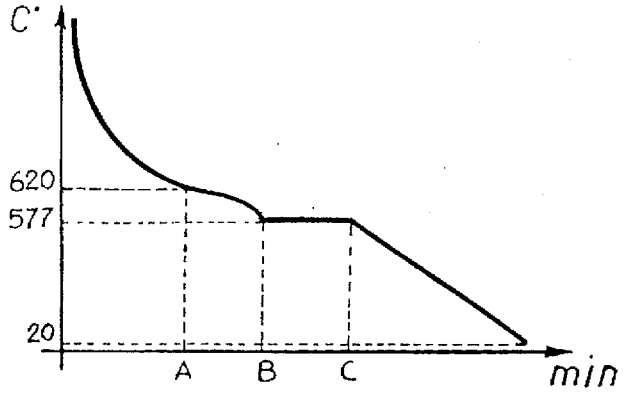
FIG 1
FIG 4
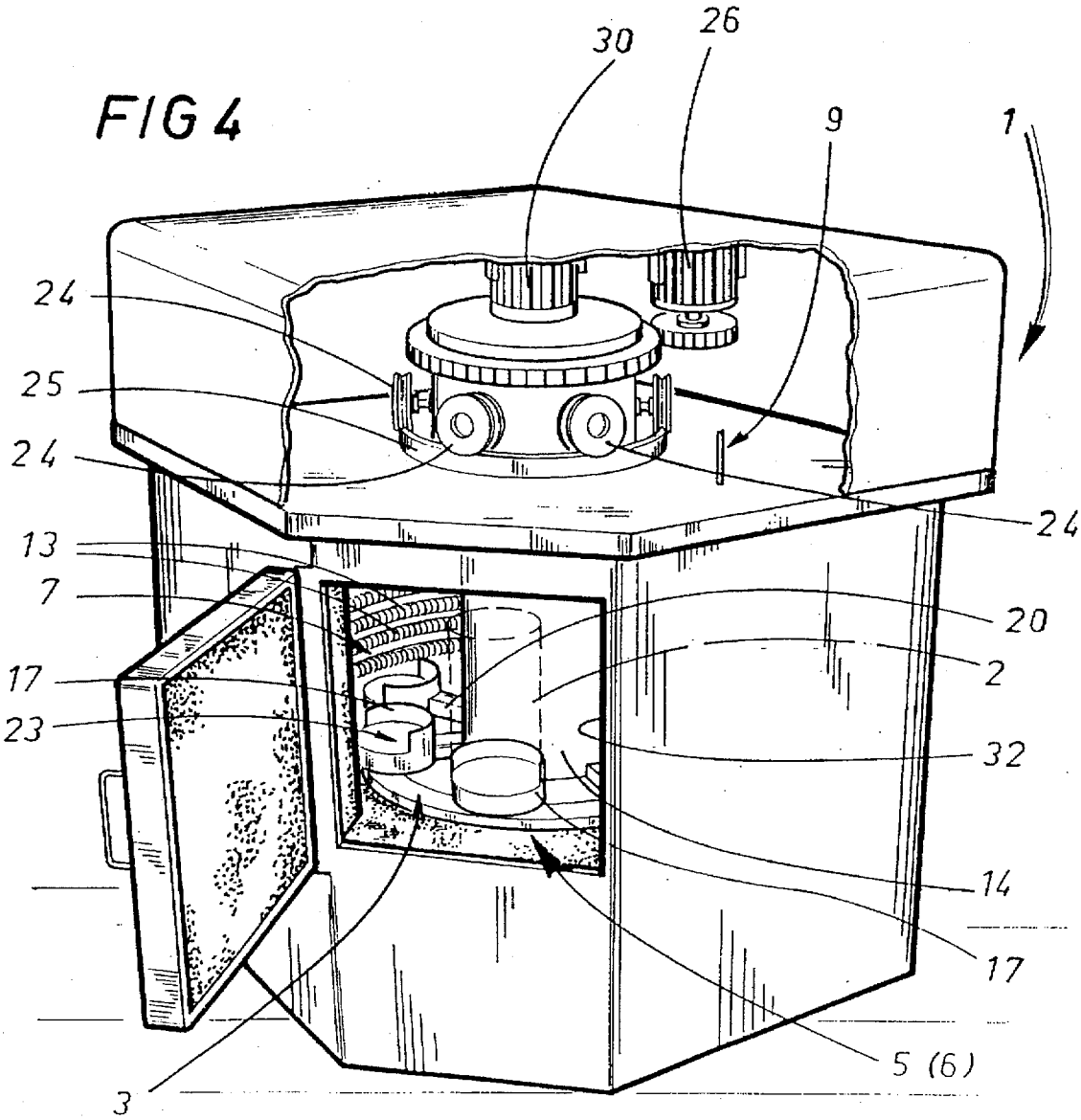

METHOD AND EQUIPMENT FOR BRINGING METAL ALLOY INGOTS, BILLETS AND THE LIKE TO THE SEMISOLID OR SEMILIQUID STATE IN READINESS FOR THIXOTROPIC FORMING

BACKGROUND OF THE INVENTION

The present invention relates to a method by which solid metal alloy castings such as ingots, billets and the like destined for thixotropic forming are brought to the semisolid or semiliquid state and to equipment for its implementation. In accordance with the invention the castings are typically alloys of aluminum, magnesium and copper.

A recent addition to the range of processes adopted, for the shaping of metal alloys, typically pressure diecasting, forming, and others, is the method known as thixotropic forming. Such a method employs ingots prepared from a metal alloy that is brought to the semisolid or semiliquid state before being shaped and the alloy exhibits a particular structure of a homogeneous arrangement of solid crystals, globules or granules immersed in a liquid phase. Accordingly, this type of process requires a partial or total fusion of those phases of the alloy with a lower melting point, while the globular phases determining the thixotropic nature of the alloy must be maintained in the solid state.

In practice, the resulting structure is composed of solid globules distributed homogeneously within a liquid phase, with no dendrites, i.e. devoid of crystals growing arborescently around nuclei. In this type of process it is essential that the proportions between solid phase and liquid phase are able to be reproduced at will in any ingot cast as a thixotropic starting material, compatibly with the type of alloy and the forming process adopted, so as to ensure that the behavior of the alloy in forming and the specifications of the end product can be maintained constant.

Referring to the accompanying drawings, the state of a metal alloy suitable for thixotropic forming is indicated schematically by the graph of FIG. 1, the part of the curve to the left of point A represents material entirely in the liquid state, whereas the part to the right of point C represents material entirely in the solid state. The parts of the curve between points A and C indicate the semisolid or semiliquid material and, more exactly, the part between B and C represents a material composed of solid crystals or granules or globules immersed in a liquid phase, which is the eutectic.

Progressing from point C to point B, the percentage of eutectic in the liquid state as opposed to solid crystals increases from 0 to 100. From point B to point A, on the other hand, it is the percentage of crystals in solid solution passing to the liquid state the increases from 0 to 100. In the case of thixotropic alloys, the areas of interest are generally B-C, where one has solid crystals together with eutectic in the liquid state, and apart of B-A depending on the liquid fraction effectively required.

An ingot of such a material will behave as a solid when conveyed or handled, but behaves in the manner of a liquid when subject to any type of forcible shaping operation.

In summary, an ingot in the thixotropic state is devoid of dendrites tending to jeopardize its homogeneous composition and mechanical strength.

Again referring to FIG. 1, and in particular to the part of the curve between B and C, it will be noted that the mere application of heat is not enough to induce the required semisolid or semiliquid state of the material. But, in practice, the material must be maintained at the requisite temperature for a given length of time.

Conventionally, an ingot of any given description in the solid state and at ambient temperature is brought to the semisolid or semiliquid state using induction furnaces, in which the heat is produced by generating a magnetic field whose flux lines directly envelop the ingot. The correct heating action, in terms of obtaining the requisite temperature and maintaining the ingots at the same temperature for the correct duration of time, usually is determined by trial and error, whereupon the conditions which are seen to produce the desired end result must be repeated exactly.

The typical induction furnace consists essentially of a cylindrical crucible accommodating a single ingot surrounded by induction coils disposed in such a manner as to generate a magnetic field with flux lines impinging on and enveloping the ingot.

Clearly, any variation in value and frequency of the magnetic field will cause a corresponding variation in the temperature applied to heat the ingot and cause a different distribution of heat between the skin and the core of the ingot. By regulating and monitoring the value of the magnetic field in the appropriate manner, the type of heating action applied to the ingot can be controlled selectively, targeting areas further and further in toward the ingot core.

The time taken by such furnaces to bring each ingot to the desired temperature will naturally depend on the dimensions of the ingot.

For a better illustration of the problem addressed by the present invention, reference may be made to a specific example: to bring an ingot some 150 mm in diameter and 380 mm in height to the semisolid or semiliquid state in the correct manner using an induction furnace of conventional type, a time of approximately 18 minutes is required. This may be acceptable in an experimental situation, but is not acceptable for industrial scale manufacture.

Considering a production rate of one ingot per minute as acceptable, a battery of 18 conventional furnaces would be required to achieve such a rate. First of all, there are serious problems of economy associated with the operation of so many furnaces, given their high overall power consumption. What is more, there is the drawback of the considerable size exhibited by the equipment, given that an induction furnace able to heat the size of ingot in question will have an external diameter of some 600 mm, to which the dimensions of the electrical panels must also be added. The size of the furnace is augmented further by being associated, necessarily, with an automatic or semi-automatic device for changing the ingot. The overall dimensions of the installation could be reduced somewhat by utilizing a single change device serving all the furnaces, though this would lead to notable structural complexities.

The prior art considers one particular multiple type of induction furnace, albeit designed for use with smaller ingots, especially in the transverse dimensions, which comprises a platform rotatable about a vertical axis and supporting a plurality of ingots spaced apart around the axis of rotation at equidistant intervals. Located above the platform is a support capable of movement in the vertical direction and carrying a plurality of open bottomed induction furnaces, the number of the induction furnaces being identical to the number of ingots carried by the platform. The support is designed to alternate between a lowered position in which the induction furnaces each encompass a relative ingot, the open bottom ends engaging in a close fit with the platform, and a raised position in which the platform is able to index through one angular step, corresponding to the distance between any two adjacent ingots. The furnaces are put into operation in such a way that they rotate around the axis of rotation and can be divided substantially into three zones of difference temperature, including one in which the temperature and the structure of the ingots is made uniform.

Not even this special multiple furnace can meet the requirements stated previously. However, such a furnace able to heat ingots of the dimensions indicated above would be unacceptable because of excessive dimensions and similarly excessive operating costs. Accordingly, the object of the present invention is to provide a method and equipment by means of which ingots can be heated to the semisolid or semiliquid state both swiftly and at reasonable cost.

SUMMARY OF THE INVENTION

The aforementioned object is realized in a method for bringing ingots or billets of thixotropic metal alloy to the semisolid or semiliquid state, in readiness for forming, which comprises the steps of introducing the ingots into a heat chamber in their solid state and heating the air within the chamber, generating convectional air currents internally of the enclosure in such a manner that the ingots are heated principally by convention, then controlling the temperature of the ingots, and finally removing the ingots from the chamber after being raised to a given temperature which is maintained for a predetermined time sufficient to induce the semisolid or semiliquid state.

The softening ingots are set in motion within the heat chamber through the agency of conveying and positioning means by which they are supported and advanced from an infeed zone to an outfeed zone.

In a preferred embodiment, the air internally of the chamber can be heated by means of a fluid fuel burner, which will also serve to generate the convectional air currents, the heat chamber in this instance affording vents through which the fumes emitted by the burner are exhausted.

Alternatively, the necessary heat can be produced by electrical resistance heaters associated at least with the side walls of the chamber and operating in conjunction with a forced ventilation system. In this case the heat output from the resistance heater can be proportioned so that the requisite temperature is initially obtained and thereafter maintained along the path followed by the ingots between the infeed and outfeed zones.

The invention also relates to equipment capable of implementing the method for bringing metal alloy ingots to the semisolid or semiliquid state as outlined above. Such equipment comprises a heat chamber, and installed and operating internally of the chamber, conveying and positioning means: such as will transfer a plurality of ingots from an infeed zone of the chamber, at which the ingots are introduced in the solid state, to an outfeed zone at which the ingots are removed ultimately in the semisolid or semiliquid state. The equipment also includes heating means operating in conjunction with forced ventilation means internally of the heat chamber in such a way as to generate convectional air currents by which the ingots are enveloped and heated.

The equipment further comprises mean to sense the temperature of the ingots which are connected to a monitoring and control unit of which the functions are to control the operation of the conveying and positioning means, the forced ventilation means and the heating mens, and also to memorize the temperature of the ingots and the rate at which the ingots are advanced through the chamber by the conveying and positioning means.

BRIEF DESCRIPTION OF THE DRAWINGS

The invention will now be described in detail, by way of example, with the aid of the accompanying drawings, in which:

FIG. 1 shows the time-vs-temperature graph relative to a possible metal alloy of thixotropic type such as might be utilized in conjunction with equipment according to the present invention;

FIG. 4 is a perspective view of the equipment as in FIG. 3.

DESCRIPTION OF THE PREFERRED EMBODIMENTS

Figure 2:
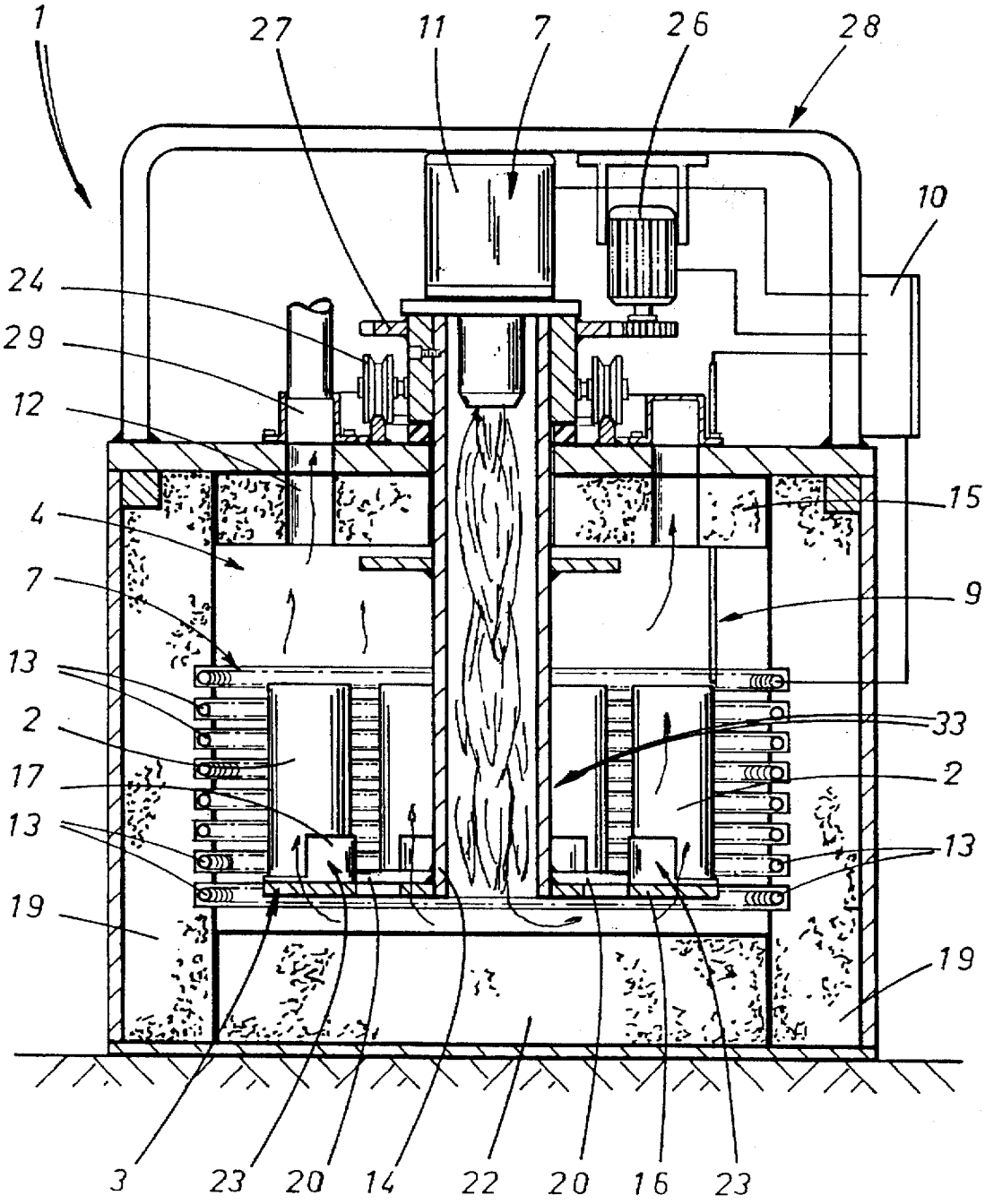
FIG. 2 illustrates the equipment according to the present invention in an elevational view partly broken away.
Figure 3:
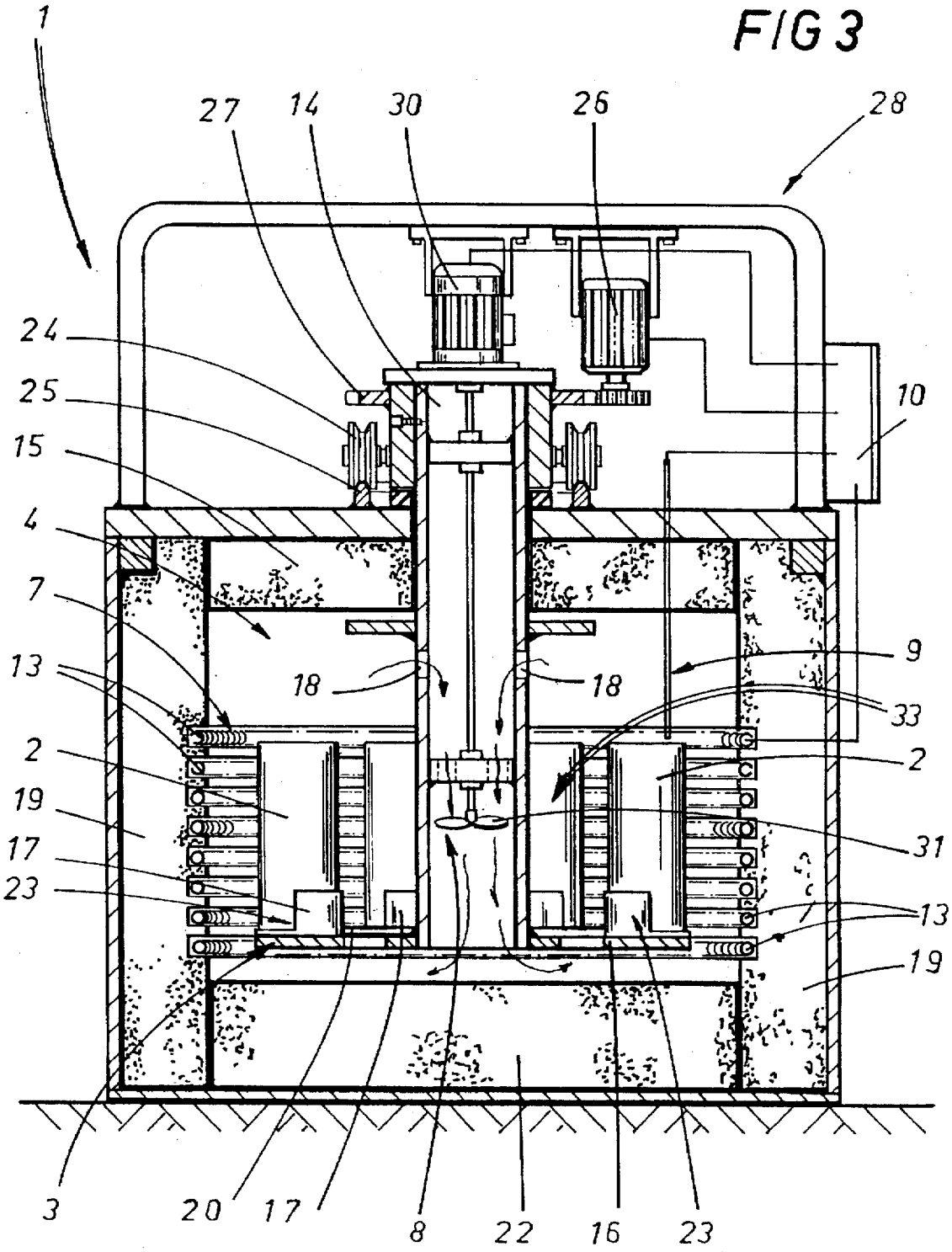
FIG. 3 is an elevational view of a different embodiment of the equipment according to the present invention, in cross-section.

With reference to FIGS. 2, 3 and 4, the present invention relates to equipment capable of bringing ingots or billets or similar castings of a metal alloy, denoted 2, to the semiliquid or semisolid or plastic state. The alloy in questions can be of aluminum or magnesium or copper and formulated in such a way as to respond to heat as indicated, by way purely of example, in the graph of FIG. 1.

As a first step of the method to which the present invention relates, ingots 2 in the solid state are introduced into a heat chamber 4 and exposed within the relative enclosure to convectional currents, or streams, of hot air. The ingots 2 are thus heated primarily by convection. The temperature of the solid ingots 2 at the moment of introduction into the heat chamber 4 will of course be substantially the same as the ambient temperature outside the chamber 4. Thereafter, the temperature of the alloy is monitored continuously within the chamber 4 and ingots 2 will be removed after being heated to a predetermined temperature and held at this same temperature for a predetermined duration sufficient to induce the semisolid or semiliquid state. Inside the heat chamber 4, the ingots 2 are set in motion through the agency of conveying and positioning means 3, and transferred from an infeed zone 5 of the chamber 4 to an outfeed zone 6 of the chamber 4.

The chamber 4 can be heated by means of a fluid fuel burner 11, which also serves to generate the convection hot air currents. The fumes produced by the burner 11 are exhausted through vents 12 positioned above and substantially in alignment with the ingots 2.

Alternatively, the heat can be generated by a plurality of electrical resistance heater elements 13 arrayed at least along the side walls 19 of the chamber 4. The electrical resistance elements 13 can be made to operate selectively in such a way as to create zones of different temperature within the chamber 4, and more precisely, in such a way that the temperature gradually increases along the path followed by the ingots 2 in their progress from the infeed zone 5 to the outfeed zone 6.

The equipment capable of implementing the method according to the present invention, denoted 1 in its entirety, comprises conveying and positioning means 3 installed within the operating internally of the heat chamber 4 of which the side walls 19, the bottom wall 22 and the top wall 15 are lined with a refractory material. The ingots 2 are advanced by the conveying means 3 from an infeed zone 5 to an outfeed zone 6, both of which situated internally of the chamber 4. Ingots 2 supplied to the infeed zone 5 at ambient temperature are taken up by the conveying means 3, and removed subsequently from the equipment 1 at the outfeed zone 6 having been conditioned to the desired semisolid or semiliquid state.

The equipment comprises means 7 by which to heat the ambient air, operating within the chamber 4, and forced ventilation means 8 serving to generate convectional currents or streams of hot air which are, played over the ingots 2. Also located within the chamber 4 are temperature sensing means 9 by which the temperature of the ingots 2 is monitored continuously.

The output of the temperature sensing means 9 is connected to the input of a monitoring and control unit 10 that controls the operation of the equipment 1 overall. In effect, this same unit 10 controls the heating means 7, the forced ventilation means 8 and the conveying and positioning means 3. The control unit 10 is programmed in such a way that the desired temperature and timing conditions are maintained internally of the chamber 4. Timing in this context signifies the duration of the period for which the ingots 2 remain inside the chamber 4.

Considering the two embodiments of FIGS. 2, 3 and 4 in greater detail, the chamber 4 has the geometry of a cylinder with a vertically disposed axis, and is formed by side walls 19 and a bottom wall 22 combining to create a crucible substantially in the form of a bucket. There also is an upper wall 15 acting as a lid. The conveying and positioning means 3 includes a rotor 33 disposed coaxially with the chamber 4 and comprising a hollow shaft 14 that is inserted through and supported by the lid 15 in such a way as to allow rotation about its own axis.

The bottom end of the hollow shaft 14 is associated with a circumferential flange 16 serving to support ingots 2.

The structure of the flange 16 can be either continuous or, preferably, discontinuous as indicated in FIG. 4, which illustrates a flange 16 embodied as a plurality of individual platforms 17 carried by respective radial arms 20 extending from the hollow shaft 14. Each platform 17 affords an arcuate element 23 serving to restrain the relative ingot 2. The hollow shaft 14 is accommodated by the lid 15 in an airtight fit and carries a plurality of freely revolving radial wheels 24, each with a peripheral groove designed to engage in rolling contact with a circular projection 25 extending from the lid 15. The hollow shaft 14 is set in rotation about its own axis by a geared motor 26 that is mounted to the lid 15, in a manner not shown in the drawings, and meshes with a gear 27 keyed to the hollow shaft 14. The operation of the geared motor 26 is controlled by the monitoring and control unit 10.

The side walls 19 of the chamber 4 afford at least one access door 32 situated next to the infeed and outfeed zones 5 and 6. The embodiment of FIG. 4 shows only one such access door 32, so that the positions of the infeed and outfeed zones 5 and 6 coincide.

The equipment operates in conjunction with means (not illustrated) by which to change the ingots 2, located externally of the heat chamber 4.

In the embodiment of FIG. 2, the heating means 7 is shown as a fluid fuel burner 11 supported by a superstructure 28 mounted to the lid 15. The flame of the burner 11 is directed down the bore of the hollow shaft 14 in such a way that the fumes emerge from the bottom end and then flow upwardly and around the ingots 2 supported by the platforms 17.

The lid 15 has a plurality of vents 12 located above and substantially in vertical alignment with the platforms 17, and connecting externally of the chamber 4 with an annular chamber 29 into which the fumes are channelled. The side walls 19 may also support electrical resistance heater elements 13, as illustrated in FIG. 2, designed to operate in conjunction with the burner 11.

In the embodiment of FIG. 3, the heating means 7 are shown as electrical resistance heater elements 13 carried at least by the side walls 19 of the heat chamber 4. In this instance, the superstructure 28 supports a motor 30 which drives a fan 31 located near the bottom end of the hollow shaft 14, thus forming the forced ventilation means 8.

While the lid 15 has no vents 12 in the embodiment of FIG. 3, the hollow shaft 14 has radial holes 18 located above the level of the fan 31 and providing air inlet ports for the forced ventilation means 8.

By proportioning the output of the resistances 13 in a suitable manner and adopting an appropriate arrangement of the radial holes 18, the interior of the heat chamber 4 can be divided into different temperature zones, and more exactly, zones in which the temperature increases gradually along the path followed by the ingots 2.

Utilizing equipment 1 embodied in the manner thus described, ingots 2 are introduced singly into the chamber 4 via the access door 32, exposed to the convection hot air currents circulated forcibly within the enclosure, heated up to a predetermined temperature and maintained at this same temperature for a given duration, then removed singly from the chamber 4 likewise via the access door 32. The monitoring and control unit 10 serves to vary the maximum temperature at which the ingots 2 are destined to soften, and more importantly, the duration for which the ingots remain in the chamber 4. With regard in particular to the length of time the ingots 2 are kept inside the heat chamber 4, it is sufficient to adjust the speed of rotation of the hollow shaft 14.

The advantages afforded by the present invention are discernible in the constructional simplicity and compact dimensions of a practical and reliable piece of equipment 1. In particular, the use of the rotor 33 operating inside the heat chamber 4 is instrumental both in reducing dimensions and in allowing several ingots 2 to be heated at once.

A further advantage of the invention is reflected in the operational versatility of the equipment 1. With convention heat as the principal means of raising temperature, it is a comparatively simple matter to heat even ingots 2 of non-cylindrical geometry, for example of square or rectangular or polygonal section. In addition, the resistances 13 can be controlled in such a way as to create zones maintained at different temperatures, so that even non-cylindrical ingots 2 can be heated correctly.

Yet another advantage of the equipment 1 is that of economy in operation, gained through the adaption of heating means 7 of a type more conventional and easier to manage than induction furnaces.

Also advantageous is the use of a single access door 32, as in FIG. 4, since with fewer openings in the chamber 4 the risk is minimized that these will upset the conditions of thermal equilibrium established internally by the convectional hot air currents.

What is claimed:

1. Equipment for bringing metal alloy ingots and billets to the semisolid or semiliquid state in readiness for thixotropic forming comprising:

a heat chamber;

conveying and positioning means internal of said heat chamber for conveying a plurality of ingots between an infeed zone at which the ingots are introduced into the heat chamber in the solid state and an outfeed zone at which the ingots are removed from the chamber in the semisolid or semiliquid state;

heating means operating internally of the heat chamber in conjunction with forced ventilation means to establish convection currents of the heated air to flow over the ingots;

means to sense the temperature of the ingots in the heat chamber;

a unit responsive to the sensed temperature of the ingots for controlling the operation of the conveying and positioning means, the forced ventilation means and the heating means.

2. Equipment as in claim 1, wherein said heating means comprises at least one fluid fuel burner which also serves as said forced ventilation means, and the uppermost part of the heat chamber having a plurality of vents for the release of fumes disposed substantially in vertical alignment with the ingots being conveyed by said conveying and positioning means.

3. Equipment as in claim 1, wherein said heating means comprises electrical resistance heating elements arrayed at least along the side walls of the heat chamber.

4. Equipment as in claim 3, wherein the electrical resistance heating elements are connected on the input side to different and independent outputs of the control unit and operated to generate and maintain contiguous zones of different temperature along the path of movement of the conveying and positioning means.

5. Equipment as in claim 1, wherein the heat chamber is substantially cylindrical with a vertically disposed axis, said conveying and positioning means comprising a vertical hollow shaft extending in coaxial alignment with the chamber, supported at the top end by an upper wall of said chamber and rotatable about its own vertical axis, a flange at the bottom end of said hollow shaft for supporting a plurality of ingots spaced apart around the axis of rotation of said shaft.

6. Equipment as in claim 5, wherein said heating means comprises at least one fluid fuel burner also constituting the forced ventilation means disposed and operating at the top end of the hollow shaft, the uppermost part of the heat chamber having a plurality of vents to release fumes disposed substantially in vertical alignment with the ingots conveyed by said conveying and positioning means, and said flange being in sections forming a plurality of platforms in a common plane disposed around the hollow shaft.

7. Equipment as in claim 5, wherein said heating means comprises electrical resistance heating elements arrayed at least along the side walls of the heat chamber operating in conjunction with forced ventilation means disposed and operating adjacent said hollow shaft, said flange being in sections forming a plurality of platforms in a common plane disposed around the hollow shaft.

8. Equipment as in claim 6, wherein the position of the infeed zone coincides with that of the outfeed zone.

9. Equipment as in claim 7, wherein the position of the infeed zone coincides with that of the outfeed zone.

10. Equipment as in claim 1 wherein said positioning and conveying means rotates the ingots within said heat chamber between the infeed zone and the outfeed zone.

11. Equipment as in claim 10 wherein said unit includes means for memorizing the maximum temperature value of the ingots and the rotational velocity of said conveying and positioning means.

* * * * *